United States Patent [19]

Eickmann

[11] Patent Number: 4,489,641

[45] Date of Patent: Dec. 25, 1984

[54] ROTOR BUSH ASSEMBLY IN FLUID MACHINES

[76] Inventor: Karl Eickmann, 2420 Isshiki, Hayama-machi, Kanagawa-ken, Japan

[21] Appl. No.: 232,746

[22] Filed: Feb. 9, 1981

Related U.S. Application Data

[62] Division of Ser. No. 910,809, May 30, 1978, abandoned, and Ser. No. 911,246, May 31, 1978, abandoned.

[51] Int. Cl.[3] ..... F01B 13/06

[52] U.S. Cl. ..... 91/498; 92/58

[58] Field of Search ..... 91/498, 491; 92/58; 308/122, 9

[56] References Cited

U.S. PATENT DOCUMENTS

| | | | |
|---|---|---|---|
| 2,213,236 | 9/1940 | Benedek | 91/498 |
| 2,449,297 | 9/1948 | Hoffer | 308/122 |
| 3,304,883 | 2/1967 | Eickmann | 92/58 |
| 3,785,708 | 1/1974 | Miyasaki | 308/9 |
| 3,874,272 | 4/1975 | Bosch | 91/498 |

FOREIGN PATENT DOCUMENTS

| | | | |
|---|---|---|---|
| 1453628 | 10/1969 | Fed. Rep. of Germany | 91/498 |

*Primary Examiner*—William L. Freeh

[57] ABSTRACT

A bush assembly is inserted into the rotor hub around a cylindrical control body which is partially extending into the bush to fill the interior of the bush. In such devices, where fluid flows through the control body and the working chambers in the rotor of the machine, leakage escaped through the clearance between the control body and the rotor. Due to the novel bush assembly the respective high pressure is led through passages which extend half way around the bush into recesses diametrically located in the bush. There the pressure is utilized to press respective seal-portions towards the control body to at least partially seal the escape of leakage, while maintaining a radial pressure balance between the control body and the bush.

6 Claims, 8 Drawing Figures

ROTOR BUSH ASSEMBLY IN FLUID MACHINES

REFERENCE TO RELATED APPLICATION

This is a divisional of my co-pending patent applications serial numbers 910,809 and 911,246 which were filed on May 30 th and 31 st 1978 respectively. Priorities of the mentioned co-pending applications are claimed herewith. This present application contains as FIGS. 1 to 7 the FIGS. 14 to 20 of the parental application as true copies thereof. The mentioned applications serial numbers 910,809 and 911,246 which were copending at the filing date of this application are now abandoned.

BACKGROUND OF THE INVENTION (a) Field of the Invention

This invention deals exclusively with fluid machines, wherein fluid flows through working chambers in a rotor, wherein the rotor has a centric bore which may be called the rotor hub and wherein a substantially cylindrical control body is inserted into the rotor hub to control the flow of fluid to and from the rotor. Such machines commonly act as pumps, motors, compressors, gas expanders or transmissions.

(b) Description of the Prior Art

A typical fluid machine of the prior art is shown in my U.S. Pat. No. 3,223,046. In the comon prior art the control body closely fits in the rotor hub. When there are balancing recesses applied as in my earlier U.S. Pat. No. 3,062,151, the rotor and control body float relative to each other on fluid films, whereby the friction between them is minimal. At very high pressures, which are sometimes desired nowadays, however, the increasing leakage with increasing pressure would make such devices uneconomical. There seem to have been attempts to seal the clearances, but as far as known to applicant, only with limited success.

The content of this application is therefore limited to the specific attempts and solutions, which are described in the present specification.

SUMMARY OF THE INVENTION

The major aim and object of the invention is, to increase the sealing between the rotor face and the control face of the rotor and control body of the fluid handling machine, at least so considerably, that the leakage through the clearance between the rotor face and the control face becomes reduced.

The invention recognizes however thereby, that a complete reduction of the leakage to zero is not possible with present day technologies. The invention is therefore satisfied with a satisfactory increase of the power or efficiency of the device by the aimed for and materialized reduction of the quantity of leakage through the rotor face and the control face.

To obtain the desired aim of the invention, either the control body is made to float more centrically, whereby leakage from eccentric floating would be reduced, for example by more simple balancing means for reduction of leakage flows, or by narrowing the clearance portions by deformations or seal-insertions.

Common to all solutions of the invention is that individual passages are extended half way around the bush which is inserted into the centric rotor hub in order to transfer the pressure in fluid in a respective working chamber to a diametrically oppositely located place, wherefrom the transferred fluid pressure can then take the desired action diametrically of the communicated individual working chamber.

DESCRIPTION OF THE PREFERRED EMBODIMENTS

Figure 1:
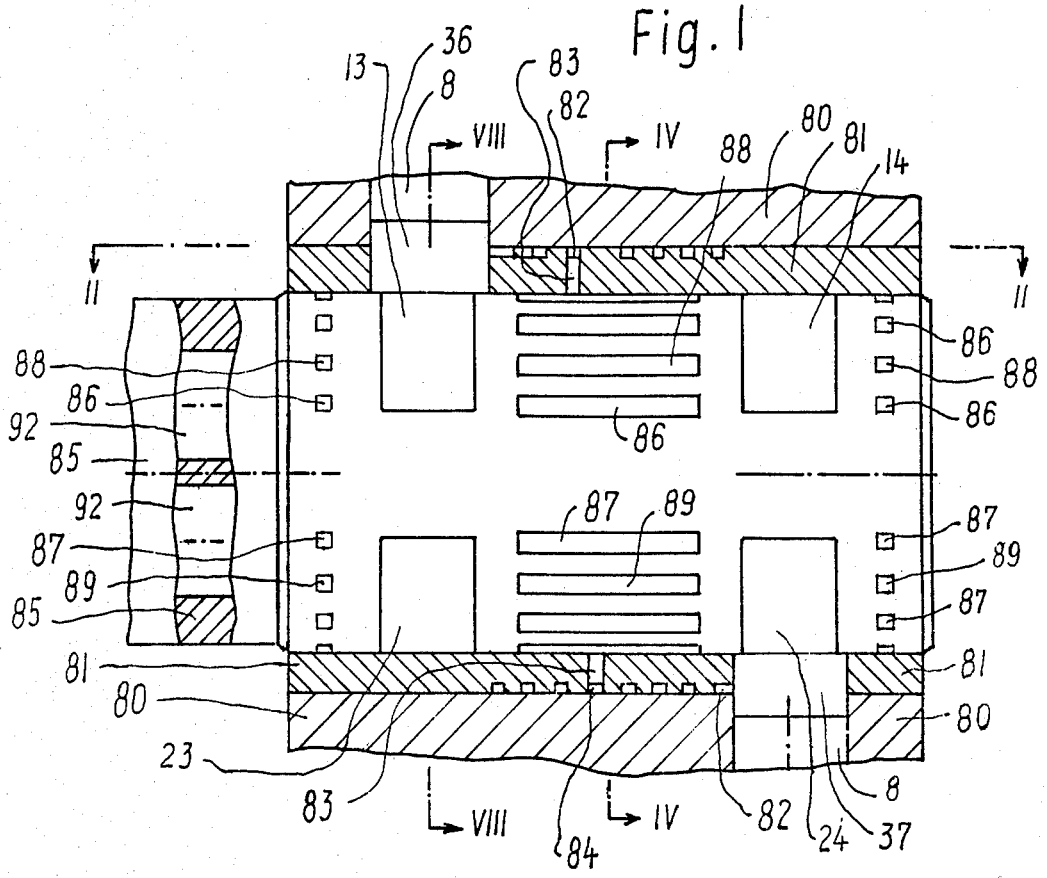
FIG. 1 is a longitudinal sectional view through a portion of a rotor of a fluid machine, wherein the respective portion of a control body is seen from the outside. Shown is an embodiment of the invention.
Figure 2:
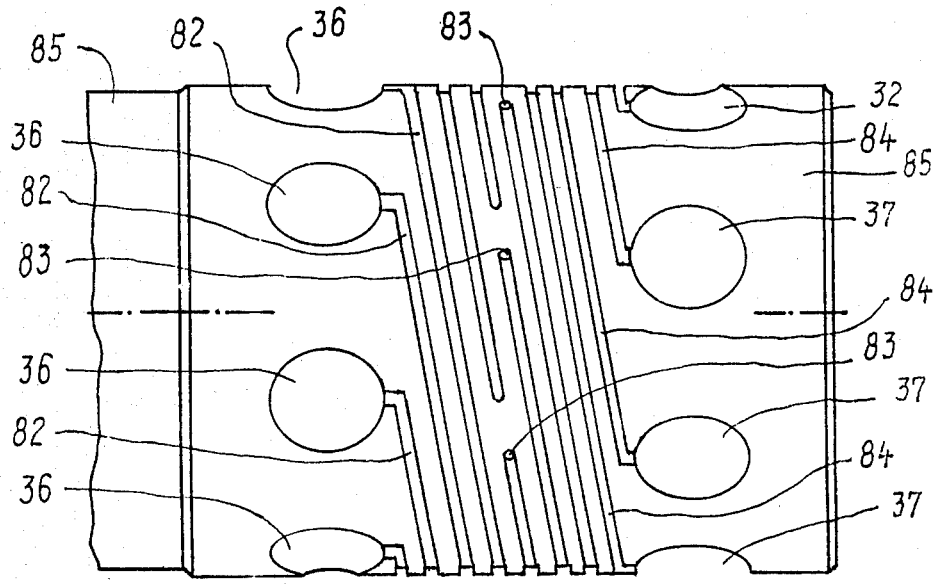
FIG. 2 is a view from top onto the outer face of the rotor bush of FIG. 1 seen along the line II—II of FIG. 1.

In the embodiment of FIGS. 1, 2, 4 and 8 the revolvably borne rotor 80 contains a plurality of working chamber or cylinder groups 36 and 37 with each group containing a plurality of individual working chambers or cylinders 36,37 with rotor parts or rotor channels 36 or 37. The different cylinder groups 36,37 may act with equal pressure on a common flow but they may also act with different pressures on different and separated flows. This embodiment shall be able to do its duty in both described possibilities. It has, therefore, to be of such structure that separated flows with different pressures are possible. For that purpose the conduits 92 through the control body 85 port into control port pairs 13,23 and 14,24 which are provided in the control body 85 in such a way that each control port pair operates the control of one of the flows to and out of the working chambers 36 or 37. Fields of fluid under pressure are then built up between the inner face of the rotor and the outer face of the control-body; not only in the control ports but also in the clearance between rotor and control body adjacent to the control ports. These pressure fields tend to incline the rotor and control body relative to each other and such inclination would cause local wear and increased leakage.

To prevent or reduce such wear and leakage a sealing arrangement is provided by this invention. The sealing arrangement which is associated to the rotor 80 and to the control body 85 consists of a bush 81 which is with its outer seat face fitted into the hiding seat of the rotor which forms the rotor hub while the bush has passages, bores and an inner face to form together with the outer face or control face of the control body the sealing arrangement. Since the inner face of the bush revolves around the control face of the control body the inner face of the bush forms a rotary face. Further details of the sealing arrangement are, for example, as follows: Passages 82,83 and probably more passages are provided in said bush or the rotor and a plurality of fluid pressure pockets, for example, 86 to 89 are provided in the outer face of the control body 85 under certain conditions and rules. These conditions and rules are, that each of the control ports 13,14,23,24 is associated with a plurality of substantially diametrically located fluid pressure pockets in the opposite outer face of the control body 85; further; that fluid pressure communications are provided from the respective cylinders or chambers 36,37 to the respective fluid pressure pockets; and finally that each of said fluid pressure pockets is separate sealed from the neighboring fluid pressure pockets and that fluid pressure pockets are at least partially located axially between the diametrically opposite located control ports with which they are associated.

Thereby it is assured in accordance with this invention, that a fluid pressure balance between rotor 80 and control body 85 is obtained whereby in case of different pressures in the flows of fluid also differently pressurized individual fluid pressure pockets are acting on the diametrical opposite side in the clearance between rotor and control body. Thereby floating of them relative to each other is obtained. The detailed structural materialization may be done, for example, as follows:

Each working chamber or cylinder 36,37 may be communicated to a separate communication passage 82,84 and so on. Each of said communication passages 82,84, etc., may extend from a chamber 36 or 37*a* half way around the bush 81 to a diametrically opposite place to meet at this place an individual radial space or radial bore 83 diametrically opposite of the bush 81. The respective individual bore 83 extends radially inwards through the bush to open on the inner face of the bush 81. The individual bores 83 are moving during revolution of rotor 80 or of control body 85 at different times and angular degrees over one after the other of each of the individual fluid pressure pockets 86 to 89 in the outer face of the control body 85. Thereby, periodically, each of the individual fluid pressure pockets 86 to 89 becomes loaded with the pressure of group 36, thereafter with the pressure of group 37, and thereafter again with the pressure of group 36 and so on in periodical cycles. Each fluid pressure pocket 86 to 89 is thus a number of times during each relative revolution periodically changing loaded with the respective pressure in the at that respective periodical time diametrically opposite located working chamber or cylinder 36 or 37. This arrangement provides the floating of rotor 80 and control body 85 relative to each other at every moment and at every angle of revolution relative to each other.

Figure 4:
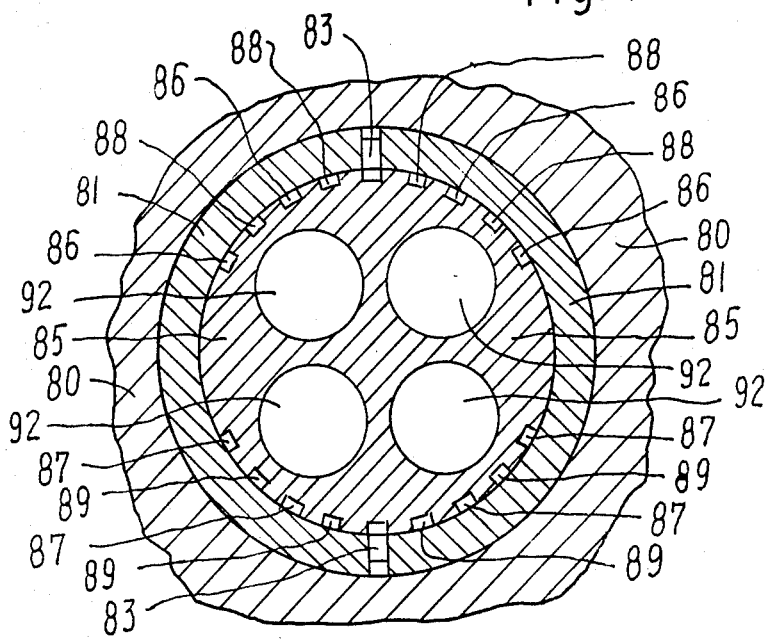
FIG. 4 is a cross-sectional view through FIG. 1, taken along the line IV—IV of FIG. 1.

The location of the fluid pressure pockets is also demonstrated in the sectional FIG. 4. The location of the respective communication passages 82 and 84 in the bush or rotor is shown in detail in FIG. 2 wherein the small circles on the ends of the passages 82 and 84 are the respective bores 83. These are not numbered in FIG. 2 because there is no space for such numbering in the Figure.

Relatively large fluid pressure pockets 86 to 89 are located axially seen between the control port pairs with end-digits 3 and 4. But it is also possible to add relatively smaller fluid pressure pockets 86 to 89 axially endwards of said control-ports. This is also shown in FIG. 1.

Figure 3:
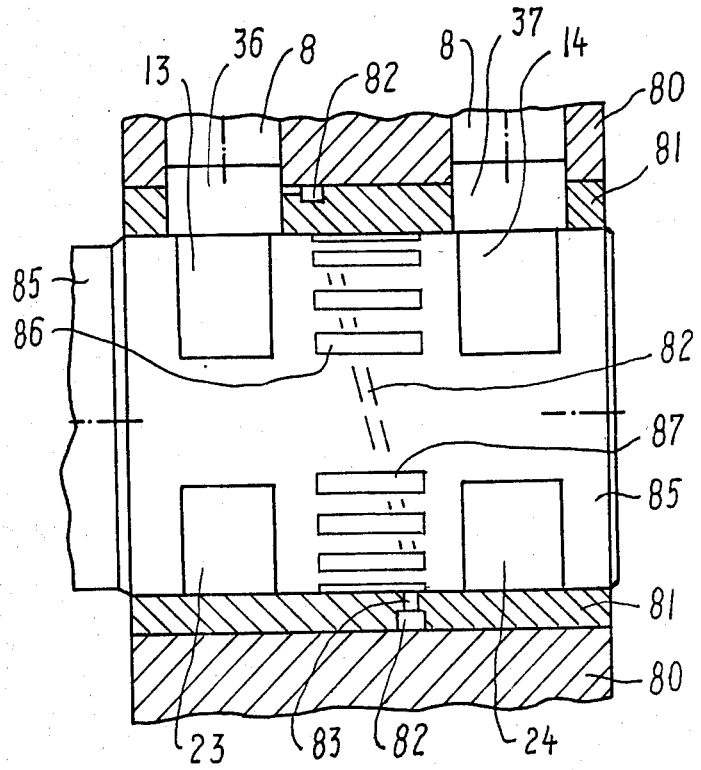
FIG. 3 is a longitudinal sectional view through a portion of a rotor of a fluid machine wherein the inserted control body portion is seen by a view onto it and the figure demonstrates another embodiment of the invention.

The fluid machine of the embodiment of FIG. 3 has two working chamber, or cylinder, groups 36 and 37 which act on a common flow of fluid through both groups 36 and 37. The consequence thereof is, that equal pressure acts in control ports 13 and 14 and another pressure of also another equal pressure or no pressure acts in control ports 23 and 24. It is, therefore, enough to lead the pressure around the bush 81 which is inserted into rotor 80 from only one of the groups 36 or 37 into the fluid pressure pockets 86 or 87 on the respective other side of the control body 85. Consequently, there are only half as many communication passages 82 than there are in FIGS. 1, 2 and 4. Bores 83 are similar to those with number 83 in FIG. 1. In the embodiment of FIG. 3 there is no need for fluid pressure balancing pockets endwards of the control ports 13,23 and 14,24. Consequently it is enough to provide the fluid pressure pockets only between the control port pairs 13-23 and 14-24.

For assuring the desired definite radial floating of rotors and control bodies relative to each other around the same and common axis, the fluid pressure pockets must be respectively accurately dimensioned and located.

In the embodiment of FIG. 5 again chamber groups 36 and 37 act on a common flow of fluid, whereby they have again equal pressures. It is, therefore, enough so, as in FIG. 3, to provide counteracting pressure means axially seen only between the control port areas 13-23 and 14-24. Rotor 100 has again a bush 101. The control ports 13,14,23,24 are provided in control body 105. Instead of providing fluid pressure balancing pockets in the outer face of the control body 105 the embodiment of this Figure has the advantage that the pressure balancing and seal means is provided in the bush 101. Recesses 102 and 106 are provided in bush 101 and extend radially through for the reception of pressure loaded thrust members 103 and 104.

Figure 5:
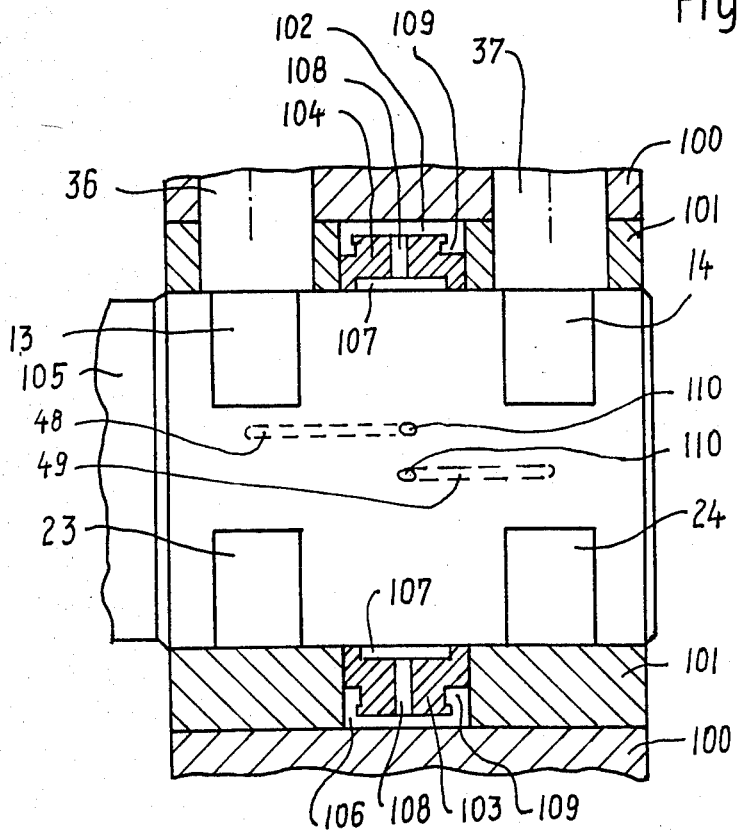
FIG. 5 is a longitudinal sectional view through a portion of a rotor showing therein a control body portion in a view onto it and the Figure demonstrates a still further embodiment of the invention.

In the embodiment of FIG. 5 the thrust members 103 and 104 are radially moveable in the respective radial recesses 102 or 106 wherein they are loaded. Fluid under pressure is led into the radially outer portions of the respective recesses 102 or 106 from the diametrically opposite located individual working chambers or cylinders 36 and/or 37. That may be done by communication passages, such as demonstrated by numbers 82 in FIG. 3. Or it may be done by communication passages through the control body 105.

In the latter case the passages 48,49 would end in respective openings or ports 110 diametrically relative to the associated and communicated chamber 36 or 37 in the outer face of the control body 105. The communications here described are not shown in FIG. 5, because their different probabilities or possibilities are already demonstrated in the mentioned other Figures. Each thrust member 103 and 104 is preferred to have on its radial inner end a fluid pressure pocket 107 which is by a respective bore 108 through thrust member 103 or 104 communicated to the outer portion of the respective recess 102 or 106. The respective outer portion of the respective recess 102 or 106 forms thereby a thrust chamber, filled periodically with pressure of fluid which presses the respective therein located thrust member 103 or 104 radially inwardly towards and against the outer face of the control body 105. The portions surrounding the pockets 107 are sealing the pocket 107 along the outer face of control body 105. The respective dimensioning of the thrust chambers 102–106 and of the therein radially moveable thrust bodies 103–104 define the force with which the thrust bodies 103 or 104 are pressed against the outer face of control body 105. If the communication through the ports 110 is provided, then the thrust chamber portions in 102 or 106 are filled with pressure and fluid through the bores 108 at those times, when the pockets 107 run over the respective ports 110.

The feature of the embodiment of FIG. 5 compared to the embodiment of FIGS. 1 to 4 is that the outer portions 121 which surround the pockets 107 seal the pockets 107 so, that almost no leakage escapes from the pockets 107. On the contrary thereto in FIGS. 1 to 4 some leakage flows out of pockets 86–87 through the clearance between rotor bush 81 and control body 85. Thus, the arrangement of FIG. 5 brings a higher volumetric efficiency than those of FIGS. 1 to 4.

The embodiment of the invention of FIG. 5 may serve two different purposes. One is to prevent leakage at the opposite diametric fluid pressure balancing pocket, when rotor 100 and control body 105 float centrically relative to each other, and the other is, or can be, to press the rotor 100 and the outer face of the control body together onto each other at the high pressure control port half of the control body 105.

In the first application case the cross-sectional areas through recesses 102,106 and through thrust members 103,104 are so dimensioned that the force through them just equals the forces of fluid which act diametrically out of the respective control ports and the clearance between rotor bush and control body in the neighborhood of the control ports.

In the case of the second application the cross-sectional areas through the said recesses 102,106 and through the said thrust members 103,104 are a little bit bigger and actually they are big enough, in detail so big, that the forces acting from them exceed the diametrical fluid pressure forces by, for example, 1 to 6 percent. Thereby the inner face of the rotor 100 or of the rotor bush 101 is pressed close to the respective control ports 13-14 and 23-14 in order to reduce axial flow of leakage out of them and at the other hand maintain still a relatively small friction between the outer face of control body 105 and said inner face of the rotor or bush. The overthrust of 1 to 6 percent is a value obtained from empirical testing. The above described first application possibility gives the smallest friction and the best device for low and medial pressure. The second application possibility is better for high pressure, because it reduces leakage but it can not maintain the same small friction as in the case of the first application. The second application possibility further has the disadvantage that the rotor and control body then float about different axes which are distanced from each other a few hundredths of a millimeter or less.

Chambers and thrust members 102,104 cooperate with control ports 23 and 24, while the opposite chambers and thrust members 106,103 cooperate with the control ports 13 and 14. The co operation of control ports with diametrically opposite located chambers and thrust members is a requirement to obtain the aim of the embodiment.

Figure 6:
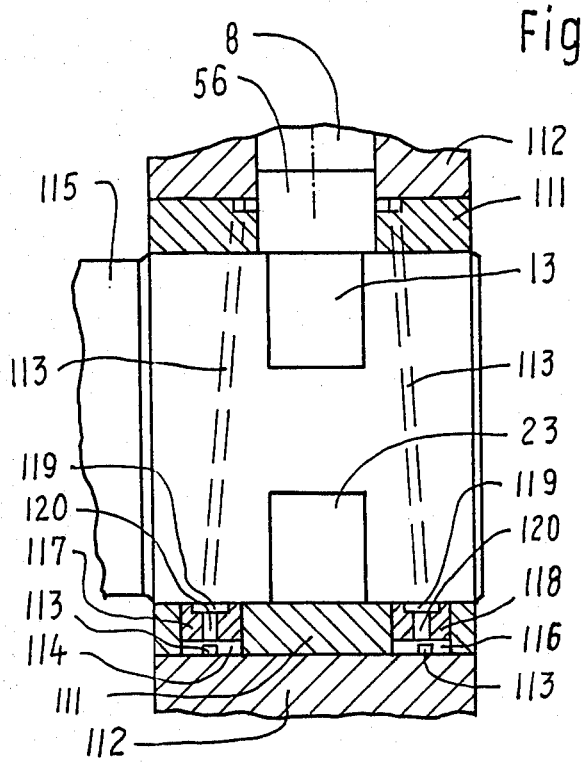
FIG. 6 is a longitudinal sectional view through a portion of a rotor of a fluid machine, showing therein in a view onto it a control body portion inserted into said rotor portion, while the Figure illustrates an additional embodiment of the invention.

The embodiment of the invention shown in FIG. 6 is a one working chamber group device which has a single working chamber group or cylinder group 56 in rotor 112. Again it has a bush in the rotor which is shown by 111. From each individual chamber 56 at least one communication passage or a pair of communication passages 113 extends to the diametrically opposite located half of the control body 115 or of the bush 111. There it ends into a pair of thrust chambers 114,116 which extend radially through the bush 11 and open towards the outer face of the control body 115. Each pair of thrust chambers has two thrust chambers 114,116 which are axially (with respect to the working chambers 56 and to the control ports 13,23) distanced from them and where one is located endwards of them in a different axial direction. The control body 115 has control ports 13 and 23. Each thrust chamber 114,115 contains a thrust member 117 or 118 radially moveable in the respective thrust chamber. Each thrust body has a passage 120 to communicate the outer portion, which is the thrust chamber portion of the respective chamber 114,116 through the respective thrust member 117,118 to the respective fluid pressure pocket 119 in the inner end of the respective thrust member 117 or 118. The fluid pressure pockets 119 are sealed along the outer face of the control body 115 by the remaining radial inner end portions of the thrust members 117 or 118.

This arrangement of FIG. 6 can again fulfill one of two possible desired purposes. Either to let the rotor and control body float centrically to each other, or to press them together at the half which contains the control ports under the higher pressure.

It is possible to extend the control body 115 and the rotor 112 with bush 111 in an axial direction in order to apply a second or more working chamber groups or cylinder groups 56 with thereto associated additional arrangements of thrust chambers and thrust members as well as the respective fluid pressure pockets and communication means.

The thrust members in FIGS. 5 and 6 may either be sealingly fitted in the respective thrust chambers or recesses, or they may be provided with grooves or means 109 for the reception of respective seal means.

Figure 7:
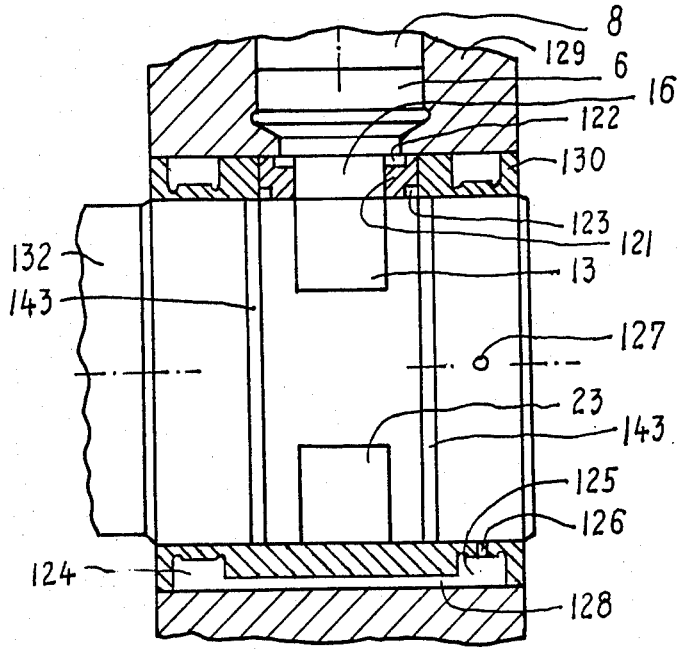
FIG. 7 is still another longitudinal sectional view through a portion of a rotor of a fluid machine, while the respectively inserted portion of a control body is again seen in a view onto it from the outside. Also this Figure demonstrates a specific embodiment of the invention.
Figure 8:
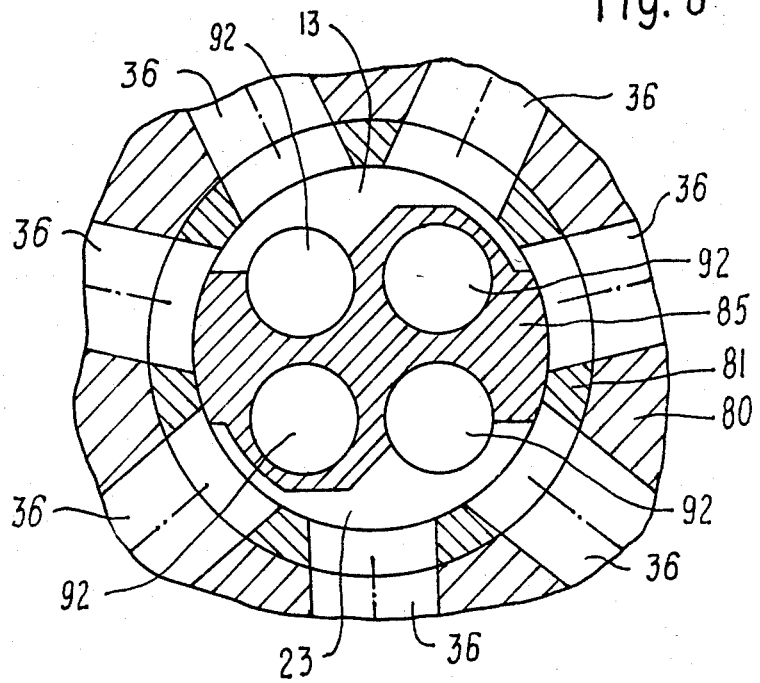
FIG. 8 is a cross-sectional view through FIG. 1 along the arrowed line VIII—VIII of FIG. 1.

In the embodiment of the invention of FIG. 7 two additional possibilities to seal against leakage between rotor 129 or rotor bush 130 and the outer face of control body 132 are shown. The first possibility is to provide a radial recess, no reference number, below the respective cylinder or working chamber 6 through the bush 130. Bush 130 may be for that purpose inserted into rotor 129. Into the said radial recess or bore a thrust member 121 may be inserted with radial moveability therein. Thrust member 121 is provided with passage 46 for the co operation with the control port pair 13,12 of control body 132. The inner face of thrust body 121 has such configuration that it slides along and seals partially along the outer face of control body 132. In order to provide a radially inwardly directed fluid pressure thrust on thrust member 121 the unloading recess 123 may be provided on the inner portion of thrust member 121 surrounding the seal face portion between passage 16 and said unloading recess 123. The thrust collection chamber 122 may be provided in the radial outer end of the thrust member 121 in order to make sure that the radial outer end of the thrust body 121 gets more fluid pressure thrust than the radial inner end. Thereby the thrust of the thrust member 121 against the outer face of the control body 132 is obtained and maintained. That provides the partial seal especially in axial direction parallel to the axis of control body 132. Each cylinder or chamber 6 may individually communicate with such a thrust chamber and such a thrust member 121. To hold the area of the control body 132 which is under pressure to a minimum the unloading grooves 143 may be provided in the outer portion of control body 132 and be communicated to a space under no or under low pressure.

The other possibility of a sealing arrangement of the invention is, to provide radially inwardly extending recesses 124 and 125 into the bush 130. Each one thereof axially spaced a little away from the respective control ports 13,23. Instead of providing each such recess 124,125 there may also a plurality of such individual recesses be provided. They have to be filled with fluid under the respective high pressure. Either from an adjacent working chamber 6 or control port 13,23 or through communications 127 through the control body 132 and communications 126 through the bush 130. Recesses 124 and 125 are axially wide enough and their bottoms are radially thin enough to allow a limited radial deflection under the pressure in them. The inner faces of the bottoms of the recesses 124 and 125 are then pressed against the outer face of control body 132 and seal there along. Passage(s) 128 may communicate recesses 124 and 126 if so desired.

From the description of the earlier embodiments it has become apparent that there are two possibilities of location of the rotor relative to the control body. The one is, that they are floating relatively to each other to a common axis. The other is, that they are relative to each other radially displaced so that, they are eccentric relatively to each other and that their axes are distanced from each other. Such distance is in practice less than a few hundredths of a millimeter and often only a few thousandths of a millimeter. The said other possibility of eccentricity between rotor and control-body is scientifically, technically and geometrically considered, an undesired and imperfect case. The ever increasing pressure in fluid machines, however, demands sometimes a compromise in favor of a tighter seal. It can therefore nowadays no more be entirely prevented to provide intentionally an eccentrical running of the rotor relative to the control body or of the control body relative to the rotor in order to obtain a smaller clearance on the respective high pressure control port half of the control body and, thereby, to obtain a tighter seal and less leakage at the high pressure side of the clearance between rotor and control body. The market demands this application because the fluid machine shall be inexpensive and of little weight.

Such eccentricity between rotor and control body demands, that the rotor is radially moveable relative to the control body, because during revolution of the rotor the rotor floats with its inner face one degree after the other a little bit towards the outer face of the control body at one half and away from it on the other half. The flexibility or radial moveability of the rotor relative to the control body is already obtained in the former art by the insertion of a crosswise slotted disc between the shaft and the rotor of the fluid machine where fingers or extensions of the rotor and shaft enter cross-wise the slots of the crosswise slotted disc. This is also done in order to prevent uncentering effects of the uncentered revolving shaft to the rotor, because such uncentered running of the less accurate machined and borne shaft would weld the more accurately machined inner face of the rotor on the outer face of the control body, since the clearance between the control body and the rotor may be smaller than the accuracy of the bearings, which bear the shaft of the fluid machine.

What is claimed is:

1. In a fluid machine, in combination, a rotor which is associated to a rotary face, a control body which has a control face which slides and seals along said rotary face and a sealing arrangement associated with said rotor, said control body and said faces; fluid conduits extended through said control body to form control ports in said control body while rotor channels which are capable and suitably located to communicate with said control ports periodically when said rotor revolves extend from said rotor face individually through at least a portion of said rotor to port into the respective periodically expanding and reducing working chambers in said rotor, whereby fluid can flow through one of said conduits and control ports and at least one of said rotor channels into at least one of said working chambers and out of the respective at least one working chamber through at least one of said rotor channels, said control ports and said conduits, while said sealing arrangement includes means for sealing along said rotor face and said control face, wherein said rotor has a concentrically located bore which forms a rotor hub which extends axially in said rotor through at least the major length of said rotor, whereby the wall of said hub forms a holding seat of at least partially cylindrical configuration, wherein said control body is a substantially cylindrical control body of a diameter only slightly smaller than the diameter of said rotary face, wherein said control body has a substantially cylindrical outer face which forms said control face and a bush is inserted into said rotor hub, having an inner face of cylindrical configuration, which forms said rotary face while said bush also has a seat face closely fitted and prevented from relative rotation in said holding seat of said rotor hub, wherein said control body extends into said bush in said rotor to face said rotary face by said control face, whereby a small clearance is provided between said rotary face and said control face, wherein said sealing arrangement consists therein, that said rotary face of said bush which revolves with said rotor receives and seals said control face of said control body, passages are provided in said outer face of said bush, closed by said holding seat outwardly and extending half way around said bush to end in diametrically opposite located places in said bush while radial bores extend from said places radially inwardly through said bush to meet respective portions of said control body; and wherein said passages are individual passages starting individually from a respective chamber of said working chambers ending individually in a respective bore of said radial bores to individually face at least temporary a portion of said sealing arrangement.

2. The machine of claim 1, wherein recesses are provided in said outer face of said control body for temporary alignment with said radial bore through said bush for the reception of fluid pressure from an oppositely and diametrically located working chamber in order to obtain said pressure in fluid in at least one of said recesses for building up a local fluid pressure field in and closely around at least one of said recesses.

3. The machine of claim 2, wherein said rotor has two groups of working chambers, wherein from each of said working chambers a respective passage of said passages extends to a respective individual place diametrically opposite in said bush relative to the axis of said bush and wherein said recesses in said control body form peripherally adjacent pairs whereof one recess of each pair is communicated to a respective working chamber of one of said working chamber groups and the other recess of the respective pair of recesses is communicated to a respective working chamber of the other of said working chamber groups.

4. The machine of claim 2, wherein said rotor contains two groups of working chambers axially spaced from each other which contain at equal times equal pressures, wherein means are provided to communicate angularly equal located working chambers of said two groups with each other and wherein said passages meet at their inner ends in said rotor face with a single common recess of said recesses in said control body.

5. The machine of claim 2, wherein said rotor contains two axially distanced working chamber groups and said recesses in said control body are axially seen respective to said rotor and control body located between said working chamber groups and respective two control ports of said control body.

6. The machine of claim 5, wherein said recesses of said control body are arranged in two groups of pairs of groups in diametrically opposed control body halves, elongated axially in said control body halves and each group of the respective group in the respective control body half is communicated to all other recesses of the same control body half.

* * * * *